United States Patent [19]

Higashiguchi et al.

[11] Patent Number: 4,592,643

[45] Date of Patent: Jun. 3, 1986

[54] COPYING MACHINE HAVING REDUCED IMAGE MEMORY

[75] Inventors: Teruaki Higashiguchi, Tokyo; Nobuhiro Miyakawa, Ashiya; Koji Yano; Kazuo Yamamoto, both of Tokyo; Yoshinobu Kawakami, Tokyo, all of Japan

[73] Assignee: Mita Industrial Co., Ltd., Osaka, Japan

[21] Appl. No.: 716,996

[22] Filed: Mar. 28, 1985

[30] Foreign Application Priority Data

| | | | |
|---|---|---|---|
| Mar. 28, 1984 | [JP] | Japan | 59-43382[U] |
| Mar. 28, 1984 | [JP] | Japan | 59-43383[U] |
| Mar. 28, 1984 | [JP] | Japan | 59-43384[U] |
| Mar. 28, 1984 | [JP] | Japan | 59-43385[U] |
| Mar. 28, 1984 | [JP] | Japan | 59-43386[U] |

[51] Int. Cl.[4] ..... G03G 15/04

[52] U.S. Cl. ..... 355/3 R; 355/67

[58] Field of Search ..... 355/3 R, 67, 71, 11, 355/66

[56] References Cited

U.S. PATENT DOCUMENTS

| | | | |
|---|---|---|---|
| 4,132,477 | 1/1979 | Watabe et al. | 355/71 X |
| 4,218,134 | 8/1980 | Kamiya et al. | 355/71 X |
| 4,522,485 | 6/1985 | Kamiya et al. | 355/71 X |

*Primary Examiner*—R. L. Moses

*Attorney, Agent, or Firm*—Sherman and Shalloway

[57] ABSTRACT

In a copying machine comprising a photosensitive drum having an amorphous silicon type photoconductive layer, if an image of an original is focussed on the photoconductive layer with a light having a wavelength shorter than 600 nm, the light fatigue of the amorphous silicon photoconductive layer is prevented, and the image memory phenomenon owing to the light fatigue is effectively obviated.

8 Claims, 13 Drawing Figures

Fig. 1-A
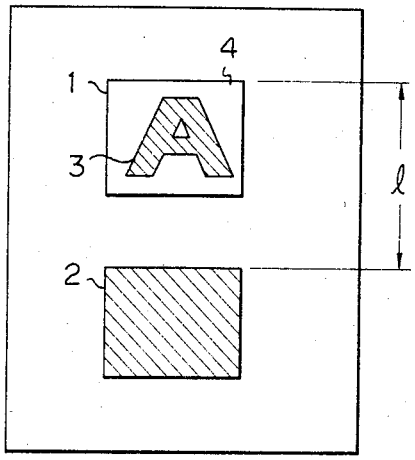
Fig. 1-B
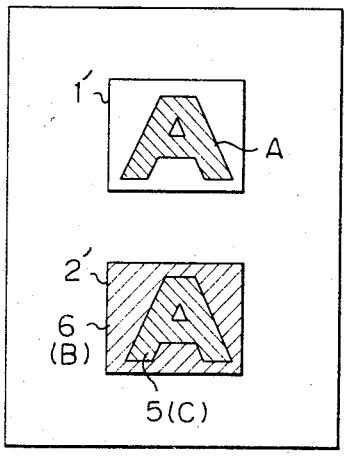

| DRUM | $S_{min}/S_{600}$ |
|---|---|
| a) | 0.69 |
| b) | 0.07 |
| c) | 0.0056 |

COPYING MACHINE HAVING REDUCED IMAGE MEMORY

BACKGROUND OF THE INVENTION (1) Field of the Invention

The present invention relates to a copying machine comprising a photosensitivity drum having an amorphous silicon type photoconductive layer formed on a photoconductive substrate. More particularly, the present invention relates to a copying machine of this type in which the image memory is effectively eliminated.

(2) Description of the Prior Art

An amorphous silicon type photoconductive layer has a high surface hardness and a sensitivity to rays on the long wavelength side and the sensitivity per se is high. Accordingly, this photoconductive layer has attracted attention as a photosensitive material for the electronic reproduction.

However, according to our research, it has been found that although amorphous silicon has the above-mentioned excellent characteristics, it is defective in that the light fatigue is relatively large in the high-speed reproduction. For example, if the operations of charging, light exposure, development, transfer and cleaning are repeated in the ordinary reproduction cycle, in case of a selenium photosensitive layer, reduction of the charge quantity at the second and subsequent stages is only about 0.5 to about 3% based on the charge quantity at the first stage and the influence of the light fatigue can be substantially neglected, but in case of amorphous silicon, reduction of the charge quantity at the second and subsequent stages is 5 to 20% based on the charge quantity at the first stage and when prints are formed at the second and subsequent stages, images of the first and precedent prints are left and formed again. That is, the problem of the image memory arises. More specifically, in the case where an amorphous silicon type photoconductive layer is used as a photosensitive material, it is a technical problem how to prevent this image memory effectively.

SUMMARY OF THE INVENTION

We found that in the case where an amorphous type silicon type photoconductive layer is used for a photosensitive drum of a copying machine, when an image of an original is formed on the photoconductive layer, rays having a wavelength within a predetermined range are used for formation of this image, the light fatigue of the amorphous silicon type photoconductive layer is prevented and the image memory to be caused by the light fatigue is effectively prevented.

It is therefore a primary object of the present invention to provide a copying machine in which the light fatigue of an amorphous silicon type photoconductive layer is eliminated and the image memory is effectively prevented.

More specifically, in accordance with the present invention, there is provided a copying machine having a photosensitive drum comprising an amorphous silicon type photoconductive layer formed on an electroconductive substrate and a light exposure mechanism in which an original placed on a transparent contact glass is irradiated with light and an image of the original is focussed on the photoconductive layer uniformly charged with a predetermined polarity through a predetermined optical system to form an electrostatic latent image, wherein the light for focussing the image of the original on the photoconductive layer is adjusted so as to have a wavelength shorter than 600 nm.

BRIEF DESCRIPTION OF THE DRAWINGS

FIGS. 1-A and 1-B are diagrams illustrating the phenomenon of the image memory.

DETAILED DESCRIPTION OF THE INVENTION

Figure 2:
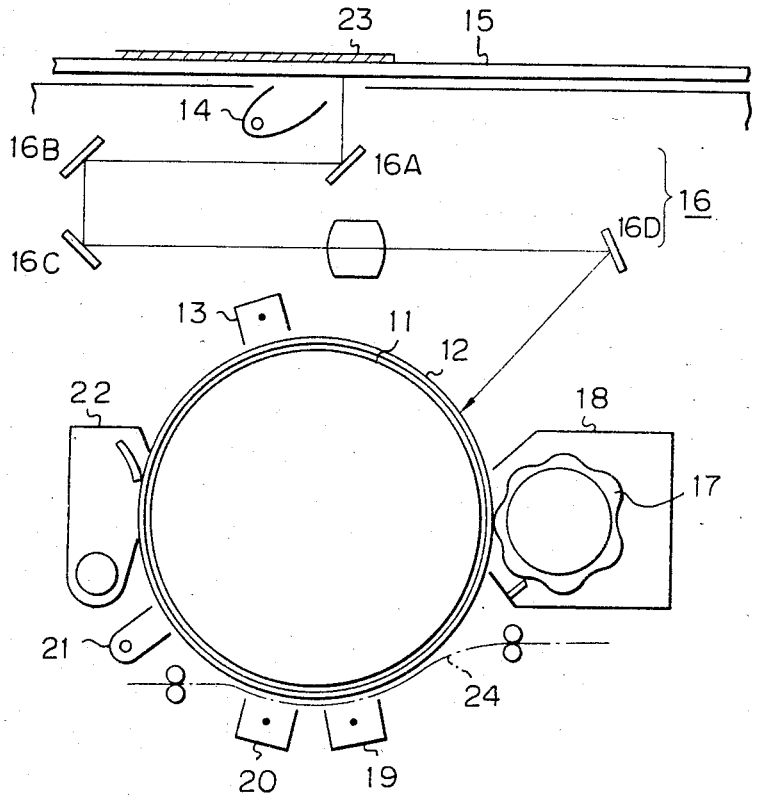
FIG. 2 is a diagram illustrating the structure of the copying machine of the present invention.

The image memory phenomenon referred to in the instant specification will now be described.

In the case where slit scanning light exposure of an original as shown in FIG. 1-A is carried out from the top end portion of the original, when the distance l between a letter portion 1 and a black solid portion 2 is in agreement with the length of the periphery of the drum, in a print as shown in FIG. 1-B there is formed an image in which the copied letter portion 1' is superposed on the copied solid black portion 2'. It is considered that this phenomenon is caused for the following reason. Namely, at the first rotation of the drum the part of a letter 3 in the letter portion 4 is not exposed to light but the background part 4 is exposed to light, and a difference of the light fatigue of the photosensitive material is brought about between the parts of the letter 3 and background 4. Accordingly, at the second rotation of the drum, if charging is effected to form a latent image of the black solid portion 2 on the surface of the photosensitive material at the above-mentioned position, the charge quantity at the part 5 where the letter appeared at the precedent rotation is maintained at substantially the same potential as at the precedent charging, but at the part 6 where the background appeared at the precedent rotation, the charge quantity is reduced because of the light fatigue and the density difference is brought about between the non-fatigue part 5 and the fatigue part 6.

Namely, in the case where an amorphous silicon type photoconductive layer is used, since this reduction of the charge quantity by the light fatigue is large, the phenomenon of the image memory takes place.

The present invention is characterized in that by using a light having a wavelength shorter than 600 nm as the focusing light, the light fatigue of the amorphous silicon type photoconductive layer is prevented and generation of the image memory owing to the light fatigue is eliminated.

The present invention will now be described in detail with reference to embodiments illustrated in the accompanying drawings.

Referring to FIG. 2 illustrating in brief the structure of the copying machine, an amorphous silicon type photoconductive layer 12 is formed on the surface of a metal drum 11 which is driven and rotated, and on the periphery of the drum 11, there are arranged, in the order recited, a corona charger 13 for the main charging, an image light exposure mechanism comprising a lamp 14, an original-supporting transparent plate 15 and an optical system 16, a development mechanism 18 having a toner 17, a toner transfer corona charger 19, a paper-separating corona charger 20, a charge-removing lamp 21 and a cleaning mechanism 22.

The photoconductive layer 12 is charged with a certain polarity by the corona charger 13. Then, an original 23 to be copied is irradiated by the lamp 14 through the contact glass 15, and the photoconductive layer 12 is exposed with the light image of the original through the optical system 16 to form an electrostatic latent image corresponding to the image of the original. This electrostatic latent image is developed with the toner 17 by the development mechanism 18. A transfer sheet 24 is supplied so that the sheet 2 is brought into contact with the drum surface at the position of the toner transfer charger 19, and corona charging is effected with the same polarity as that of the electrostatic latent image from the back of the transfer sheet 24 to transfer the toner image onto the transfer sheet 24. The tranfer sheet 24 having the toner image transferred thereon is electrostatically peeled from the drum by the charge-removing action of the separating corona charger 20 and is then fed to a treating zone such as a fixing zone (not shown).

After transfer of the toner image, the photoconductive layer 12 is entirely exposed to light by the charge-removing lamp 21 to erase the residual charge, and the residual toner is removed by the cleaning mechanism 22.

As pointed out hereinbefore, the amorphous silicon photosensitive layer 12 used in the present invention shows such a light fatigue as cannot be neglected, and the charge potential of the photosensitive layer after the light exposure is reduced by 20% at most based on the charge potential of the non-exposed portion of the photosensitive layer, and the image density of the print obtained at the second or subsequent operation is greatly different from the image density of the first-formed print.

The present invention is based on the novel finding that the light fatigue of the amorphous silicon type photoconductive layer is greatly influenced by the wavelength of the light to which the photoconductive layer is exposed and by carrying out the light exposure in a spectral wavelength region having a wavelength shorter than 600 nm, the problem of the image memory owing to the light fatigue is obviated and images can be obtained at a certain high density.

Figure 3:
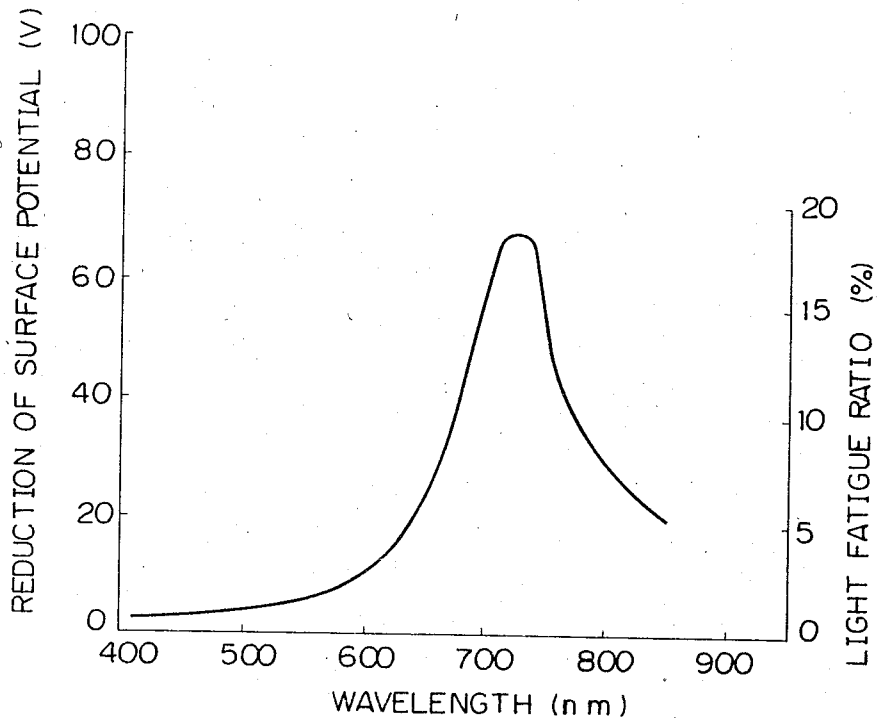
FIG. 3 is a graph illustrating the dependency of the light fatigue on the wavelength.

FIG. 3 is a graph showing the dependency of the light fatigue on the wavelength, and the wavelength at the light exposure of the photosensitive layer is plotted on the abscissa and the quantity or degree of reduction of the surface potential (light fatigue ratio, %) is plotted on the ordinate (the initial surface potential is 400 V). From FIG. 3, it is seen that the light fatigue of amorphous silicon depends greatly on the wavelength of the light, and a maximum fatigue occurs at a wavelength of 725 nm and no substantial fatigue takes place to rays having a wavelength shorter than 600 nm.

Figure 4:
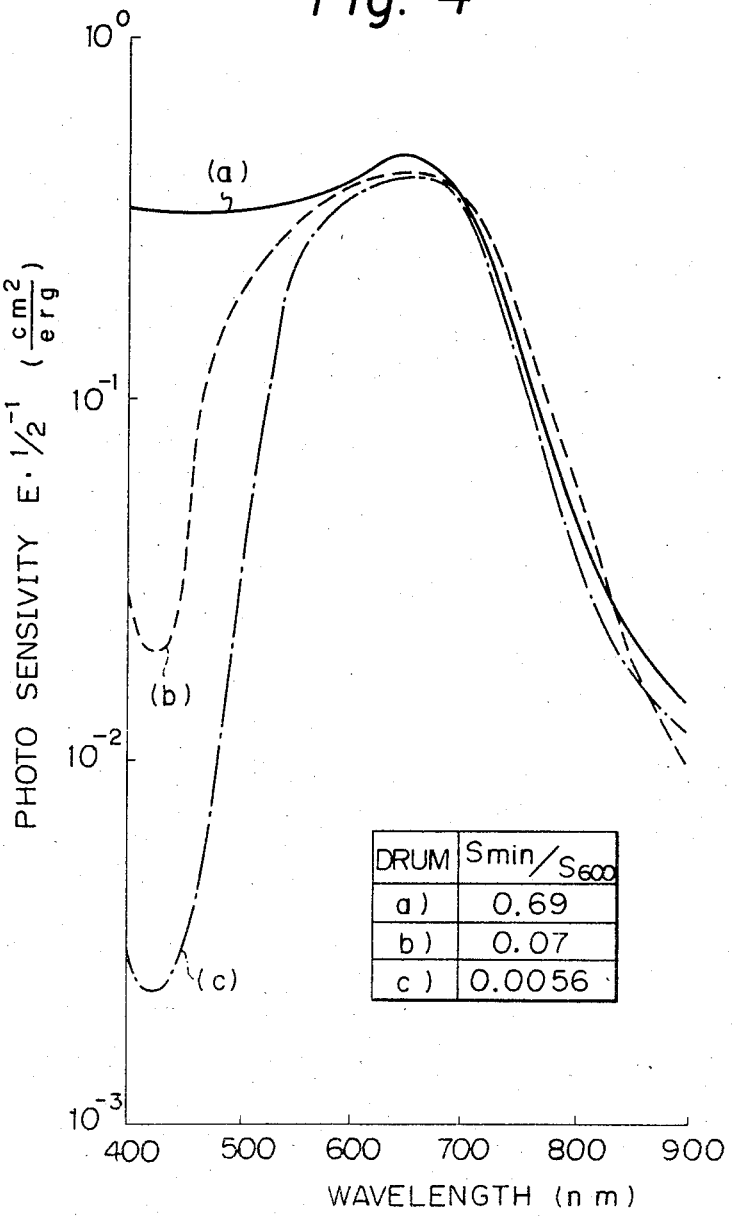
FIG. 4 is a curve showing the spectral sensitivity of amorphous silicon.

FIG. 4 is a curve showing the spectral sensitivity of amorphous silicon, and it is seen that the sensitivity is drastically reduced at a wavelength larger than 850 nm.

According to the present invention, by using rays having a wavelength smaller than 600 nm for the light exposure, the light fatigue of an amorphous silicon type photoconductive layer is prevented and occurrence of the phenomenon of the image memory is effectively reduced.

For performing the light exposure by using rays having such a wavelength, a laminate multilayer film 51 comprising two dielectric material layers differing in the refractive index is formed, instead of a silver or aluminum vacuum-deposited layer, as a reflecting mirror surface on at least one of mirrors 16A, 16B, 16C, . . . for the copying machine (see FIG. 5), so that rays having a wavelength of at least 600 nm are allowed to pass through the reflecting mirror but rays having a wavelenth shorter than 600 nm are reflected. In this case, only the rays having a wavelength shorter than 600 nm make contributions to the imagewise light exposure, and hence, the light fatigue of the amorphous silicon type photoconductive layer 12 is obviated and occurrence of the phenomenon of the image memory is prevented.

As the dielectric film formed on the mirror for the copying machine, in order to allow transmission of rays having a wavelength of at least 600 nm, there is used a laminated of a film of ZnS, SiO or $CeO_2$ and a film of $MgF_2$, cryolite or $SnO_2$, and a combination of ZnS and $MgF_2$ is especially preferred. These dielectric films are formed on the mirror by vacuum deposition.

The thickness of the dielectric film layers are appropriately determined according to the kinds of dielectric materials so that rays having a wavelength of at least 600 nm are transmitted.

The kind of the mirror for the copying machine, on which a dielectric film laminate as described above is formed, is not particularly critical, so far as the imagewise light exposure is effected with rays having a wavelength shorter than 600 nm, but it is especially preferred that the dielectric film laminate be formed on a mirror for the copying machine which is designed so that the incident angle of the rays is 45°.

Figure 6:
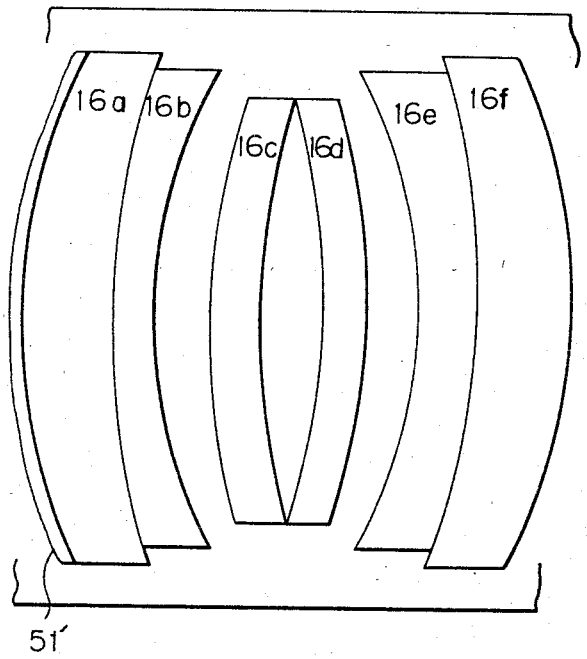
FIG. 6 is a diagram showing the sectional structure of a lens for a copying machine, which comprises a multilayer film of a dielectric material according to the present invention.

In the present invention, as shown in FIG. 6, the multilayer film 51 of dielectric materials (the multilayer film is shown entirely as a coating layer 51' in FIG. 6 for the sake of convenience) may be formed on at least one of lenses **16*a*, 16*b*, 16*c***, . . . for the copying machine. If this lens is used so that only rays having a wavelength shorter than 600 nm are passed through the lens, only rays having a wavelength shorter than 600 nm make contributions to the imagewise light exposure.

Figure 7:
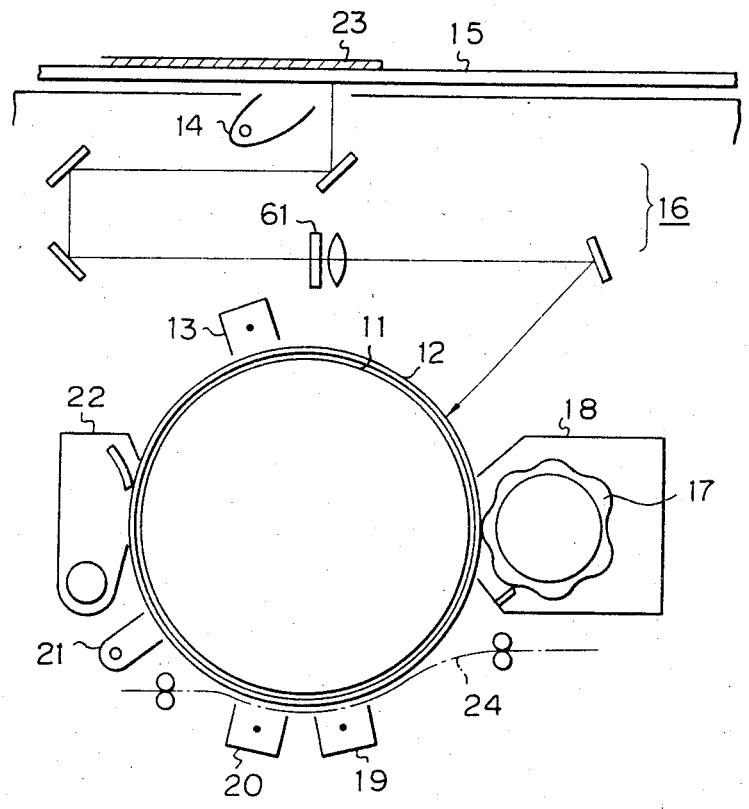
FIG. 7 is a diagram illustrating an embodiment of the copying machine of the present invention in which an interference filter is used as the light-adjusting means.

In accordance with another embodiment of the present invention, an interference filter 61 is arranged in a light path in the optical system 61 to block up rays having a wavelength of at least 600 nm (see FIG. 7). In this embodiment a laminate of a film of ZnS, SiO or $CeO_2$ and a film of $MgF_2$, cryolite or $SnO_2$ is used as the interference filter, and a combination of ZnS and $MgF_2$ is especially preferred. These dielectric films are formed on a transparent glass or film by vacuum deposition.

Also in this embodiment, the thicknesses of the respective dielectric films are appropriately determined according to the kinds of the dielectric materials so that rays having a wavelength of at least 600 nm are blocked up.

In accordance with still another embodiment of the present invention, the imagewise light exposure is carried out by using a light source 14 having an emission spectrum of a wavelength shorter than 600 nm, whereby the light fatigue of the amorphous silicon type photoconductive layer is prevented and occurrence of the phenomenon of the image memory is effectively prevented.

As the light source 14, there can be mentioned, for example, a fluorescent lamp, a green fluorescent lamp, a blue flourescent lamp, a green neon lamp and a green light-emitting diode. Since a halogen lamp customarily used as the light source for the copying machine includes rays having a longer wavelength, as pointed out hereinbefore, the light fatigue of the photoconductive layer 12 is violent.

In accordance with a further embodiment of the present invention, a color glass blocking up red rays and near infrared rays is used as the contact glass 15, and the light exposure is effected substantially by rays having a wavelength shorter than 600 nm.

For example, a blue glass can be used as the color glass, or such a color glass may be bonded to a transparent contact glass.

Any of known amorphous silicon type photoconductive layers can be used in the present invention. For example, amorphous silicon formed on a substrate by plasma decomposition of a silane glass may be used, and this silicon may be doped with hydrogen or halogen or doped with an element of the group III or V of the Periodic Table, such as boron or phosphorus.

Physical values of a typical amorphous silicon photosensitive material are a dark conductivity of up to $10^{-12}\Omega^{-1}.cm^{-1}$, an activating energy smaller than 0.85 eV, a photoconductivity higher than $10^{-7}\Omega^{-1}.cm^{-1}$ and an optical handcap of 1.7 to 1.9 eV, and the amount of combined hydrogen is 15 to 20 atomic % and the dielectric constant of a film of this photosensitive material is 11.5 to 12.5.

Positive charging or negative charging of this amorphous silicon photoconductive layer 12 is possible according to the kind of the dopant, and the voltage applied to the corona charger is ordinarily in the range of from 5 to 8 KV.

In this amorphous silicon photoconductive layer, a blocking layer may be formed on the electroconductive substrate side to effectively retain the surface charge. Ordinarily, in roder to make the charge polarity of the blocking layer in agreement with that of the photoconductive layer, the blocking layer is doped with the same dopant as used for the photoconductive layer at a concentration much higher than in the photoconductive layer.

In order to prevent flowing of the image, a protecting layer of a-$Si_x.C_{1-x}$, a-$SiN_x$ or the like may be formed on the amorphous photoconductive layer 12. In the present invention, as shown in the examples given hereinafter, when the spectral sensitivity characteristic of the photosensitive material on the short wavelength side satisfies the requirement of Smin/S600>0.07, especially Smin/S600>0.1, the image memory is prevented most prominently. In the above formula, S600 represents the photosensitivity to a ray having a wavelength of 600 nm and Smin represents a minimum photosensitivity to rays having a wavelength shorter than 500 nm (visible region).

The reason why the above effect is attained has not been completely elucidated. However, it is believed that the above-mentioned effect may probably be due to the following mechanism. In the copying machine of the present invention, since the light exposure is effected with short-wavelength rays, from which rays having a wavelength of at least 600 nm have been cut, a carrier is produced in the vicinity of the surface of the amorphous silicon type photoconductive layer 12 or in the surface protecting layer by the short-wavelength component contained in the exposure light, and if the spectral sensitivity of the surface protecting layer is low, the carrier stays in this surface protecting layer. Namely, when a protecting layer of a low sensitivity, which fails to satisfy the requirement of the above formula, at the second or subsequent image-forming step, the surface charge is neutralized at the time of corona discharge, and the surface potential is reduced and the image memory is caused to occur. Accordingly, it is believed that if the spectral sensitivity of the photosensitive material on the short wavelength side is maintained at a level exceeding a certain value so that the requirement of the above formula is satisfied, occurrence of the image memory phenomenon is prominently controlled.

In an a-Si alloy such as a-$Si_{1-x}C_x$, a-$Si_{1-x}N_x$ or a-$Si_{1-x}O_x$, the absorption of rays having a short wavelength is increased with increase of the value x but the carrier range is narrowed, and hence, the photosensitivity to rays in the short wavelength region is ordinarily reduced as a whole. The thickness of the protecting layer for controlling this reduction is 1 μm at most, and the reduction of the photosensitivity is controlled by doping with B or P. Consequently, in case of positive charging, the short wavelength sensitivity is determined by three factors, that is, the value x, the film thickness and the amount doped of the dopant B. As the surface protecting layer satisfying the requirement of the above formula, there can be mentioned, for example, a layer having a thickness of 0.1 μm, which is composed of a-$Si_{0.6}N_{0.4}$ and is doped with 500 ppm of B. In this layer, the value Smin/S600 is 0.91. Incidentally, the wavelength value Smin is hardly changed whether the alloying component is C, N or O.

The present invention will now be described in detail with reference to the following examples that by no means limit the scope of the invention.

EXAMPLE 1

Figure 8:
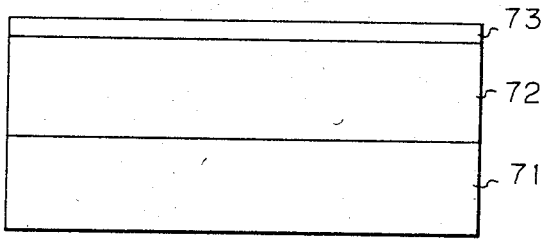
FIG. 8 is a diagram illustrating the film structure of an amorphous silicon photoconductive material to be used in the present invention.

Experiments were carried out by using a photosensitive drum (diameter=90 mm) of a-Si:H having a layer structure shown in FIG. 8. In FIG. 8, reference numeral 71 represents an electroconductive substrate of Al, reference numeral 72 represents a photosensitive layer of a-Si:H and reference numeral 73 represents a surface protecting layer composed of a-$Si_{1-x}N_x$:B. A photosensitive material (a), (b) or (c) having this layer structure and a composition shown in Table 1 was attached to a commercially available electrostatic copying machine (Model DC-211 supplied by Mita Industrial Co.).

TABLE 1

| Photosensitive Material | Thickness (μm) of a-Si:H | Thickness (μm) of a-$Si_{1-x}N_x$ | x | B (ppm) |
|---|---|---|---|---|
| (a) | 20 | 0.1 | 0.3 | 200 |
| (b) | 20 | 0.3 | 0.3 | 100 |
| (c) | 20 | 0.1 | 0.55 | 200 |

The spectral sensitivities and Smin/S600 values of these a-Si:H drums are shown in FIG. 4.

Figure 5:
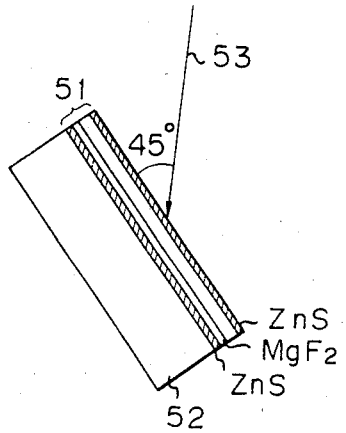
FIG. 5 is a diagram showing the sectional structure of a mirror for a copying machine, which comprises a multilayer film of a dielectric material according to the present invention.

In the above-mentioned copying machine, a cold cathode discharge tube of a green color was used as the charge-removing light source, and as shown in FIG. 5, ZnS and $MgF_2$ were alternately vacuum-deposited on a glass substrate 52 as a vacuum-deposited multilayer 51 on one surface of a copying mirror 16A for cutting rays having a wavelength of at least 600 nm, so that the incident angle of rays for the light exposure was 45°. The original used at the experiments had a size of A-3, and as shown in FIG. 1-A, the original had a black solid letter part 3 having a reflection density of 1.5 in the former portion and an intermediate black solid part 2 having a reflection density of 0.8 in the latter portion. The value l in the original shown in FIG. 1-A was adjusted to about 28 cm which was equal to the circumferential length of the drum having a diameter of 90 nm.

The reflection densities of the parts (A), (B) and (C) of the print obtained by the above-mentioned electrophotographic copying machine were shown in Table 2.

(A): corresponding to the letter part 3

(B): corresponding to the part 6 in FIG. 1-B

(C): corresponding to the part 5 in FIG. 1-B

TABLE 2

| | Photosensitive Drum | | |
|---|---|---|---|
| | (a) | (b) | (c) |
| (A) | 1.31 | 1.30 | 1.31 |
| (B) | 0.70 | 0.71 | 0.72 |
| (C) | 0.70 | 0.78 | 0.86 |
| (C) − (B) | 0.0 | 0.07 | 0.14 |

Figure 9:
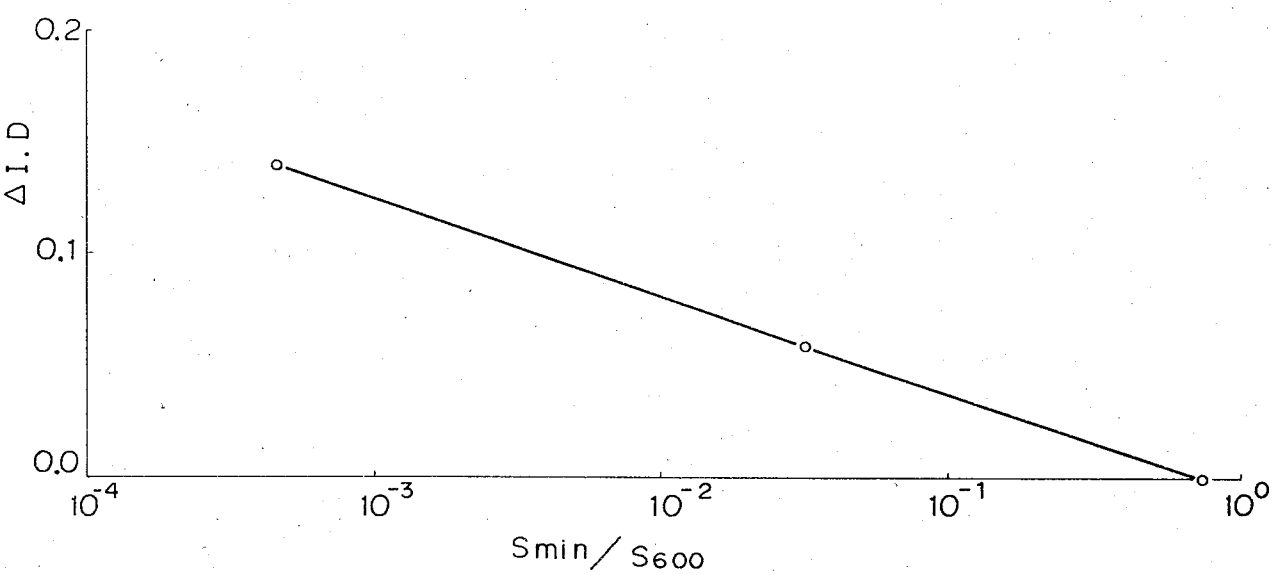
FIG. 9 is a graph illustrating the relation between the value Smin/S600 indicating the photosensitivity on the short wavelength side and the image density difference ΔID.

A graph illustrating the relation between the value Smin/S600 and the image density difference ΔID((C)-(B)) is shown in FIG. 9.

From the foregoing results, it will readily be understood that by imparting an appropriate photosensitivity to the surface protecting layer and combining this surface protecting layer with the optical system of the present invention, the image memory can be effectively prevented.

EXAMPLE 2

In the same manner as described above, a vacuum deposition multilayer 51' was formed on one surface of the copying lens **16*a*, instead of the copying mirror in Example 1, by alternately vacuum-depositing ZnS and $MgF_2$, so that rays having a wavelength of at least 600 nm were cut. An a-Si:H layer (doped with 200 ppm of B) having a thickness of 0.1 μm was disposed as the blocking layer between the substrate 71 and the photoconductive layer 72** in the photosensitive drum (a), (b) or (c) used in Example 1.

The copying operation was carried out by using this copying machine in the same manner as described in Example 1, and the reflection densities of the obtained print were determined. The obtained results are shown in Table 3.

TABLE 3

| | Photosensitive Drum | | |
|---|---|---|---|
| | (a) | (b) | (c) |
| (A) | 1.31 | 1.30 | 1.31 |
| (B) | 0.70 | 0.71 | 0.72 |
| (C) | 0.70 | 0.78 | 0.86 |
| (C) − (B) | 0.0 | 0.07 | 0.14 |

EXAMPLE 3

Figure 10:
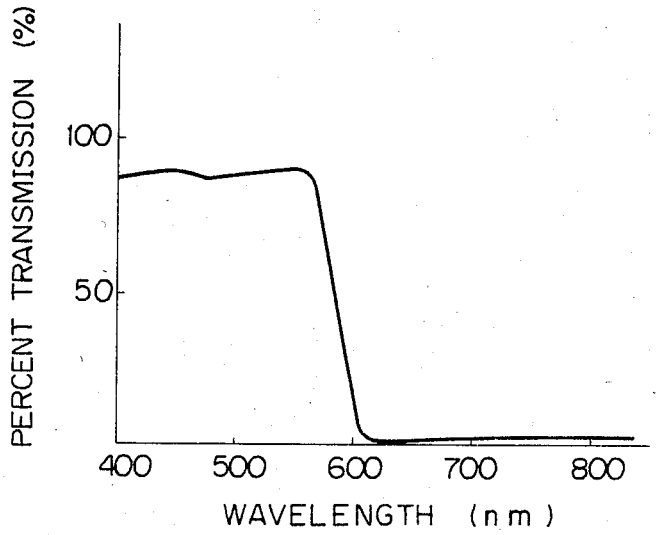
FIG. 10 is a graph showing the percent transmission of the interference filter used in Example 3.

An interference filter formed by alternately vacuum-depositing ZnS and $MgF_2$ on a transparent glass sheet was attached before the lens of the optical system 16 instead of the dielectric layer formed on the mirror of the copying machine in Example 1. The curve of the percent transmission of this interference filter is shown in FIG. 10.

In the same manner as described above, the copying operation was carried out and the reflection densities of the respective parts of the obtained print were measured. The obtained results are shown in Table 4.

TABLE 4

| | Photosensitive Drum | | |
|---|---|---|---|
| | (a) | (b) | (c) |
| (A) | 1.31 | 1.30 | 1.31 |
| (B) | 0.70 | 0.71 | 0.72 |
| (C) | 0.70 | 0.78 | 0.86 |
| (C) − (B) | 0.0 | 0.07 | 0.14 |

EXAMPLE 4

Figure 11:
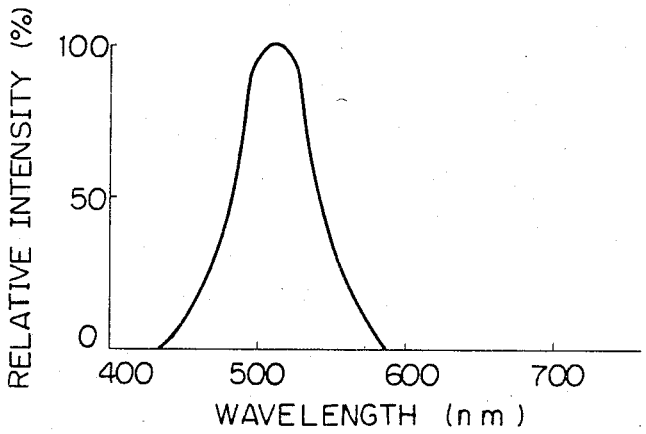
FIG. 11 is a graph showing the relative emission spectrum of the green fluorescent lamp used in Example 4.

A green fluorescent lamp was disposed as the light source for the light exposure instead of provision of the dielectric layer on the mirror of the copying machine in Example 1. The relative emission spectrum of this green fluorescent lamp is shown in FIG. 11.

The copying operation was carried out in the same manner as described in Example 1 and the reflection densities of the respective parts of the obtained print were measured. The obtained results are shown in Table 5.

TABLE 5

| | Photosensitive Drum | | |
|---|---|---|---|
| | (a) | (b) | (c) |
| (A) | 1.31 | 1.30 | 1.31 |
| (B) | 0.70 | 0.71 | 0.72 |
| (C) | 0.70 | 0.78 | 0.86 |
| (C) − (B) | 0.0 | 0.07 | 0.14 |

EXAMPLE 5

Figure 12:
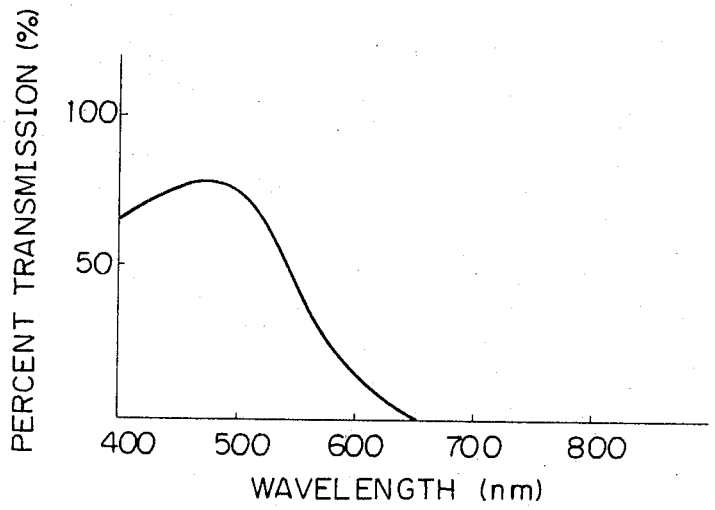
FIG. 12 is a graph showing the stectral transmission of the color glass used in Example 5.

A bluish green color glass was used as the contact glass instead of provision of the dielectric layer on the mirror of the copying machine in Example 1. The spectral percent transmission of this color glass is shown in FIG. 12.

In the same manner as described in Example 1, the copying operation was carried out by using this copying machine, and the reflection densities of the respective parts of the obtained print were measured. The obtained results are shown in Table 6.

TABLE 6

| | Photosensitive Drum | | |
|---|---|---|---|
| | (a) | (b) | (c) |
| (A) | 1.31 | 1.30 | 1.31 |
| (B) | 0.70 | 0.71 | 0.72 |
| (C) | 0.70 | 0.78 | 0.86 |
| (C) − (B) | 0.0 | 0.07 | 0.14 |

We claim:

1. A copying machine having a photosensitive drum comprising an amorphous silicon type photoconductive layer formed on an electroconductive substrate and a light exposure mechanism in which an original placed on a transparent contact glass is irradiated with light and an image of the original is focussed on the photoconductive layer uniformly charged with a predetermined polarity through a predetermined optical system to form an electrostatic latent image, wherein the light for focussing the image of the original on the photoconductive layer is adjusted so as to have a wavelength shorter than 600 nm.

2. A copying machine as set forth in claim 1, wherein a multilayer film of a dielectric material is formed on at least one of mirrors constituting the optical system, whereby the focussing light is adjusted so as to have a wavelength shorter than 600 nm.

3. A copying machine as set forth in claim 1, wherein a multilayer film of a dielectric material is formed on at least one of lenses constituting the optical system, whereby the focusing light is adjusted so as to have a wavelength shorter than 600 nm.

4. A copying machine as set forth in claim 2 or 3, wherein the dielectric material is $ZnS\text{-}MgF_2$.

5. A copying machine as set forth in claim 1, wherein an interference filter for blocking up rays having a wavelength of at least 600 nm is disposed in an optical path extending from the light source to the photoconductive layer.

6. A copying machine as set forth in claim 1, wherein the light source having an emission spectrum below 600 nm is used.

7. A copying machine as set forth in claim 1, wherein a color glass blocking up red rays and near infrared rays is used as the contact glass, whereby the focussing light is adjusted so as to have a wavelength shorter than 600 nm.

8. A copying machine as set forth in any one of claims 1 through 7, wherein the amorphous silicon type photoconductive layer has a spectral sensitivity characteristic on the short wavelength side, which satisfies the requirement represented by the following formula:

$$Smin/S600 > 0.07$$

wherein S600 represents the photosensitivity to a ray having wavelength of 600 nm and Smin represents the minium photosensitivity to rays having a wavelength shorter than 500 nm.

* * * * *